United States Patent [19]

Walsh

[11] Patent Number: 4,785,329

[45] Date of Patent: Nov. 15, 1988

[54] MONITORING WINDOW EXPANSION FOR DIAGNOSTICS

[75] Inventor: Frank R. Walsh, Webster, N.Y.

[73] Assignee: Xerox Corporation, Stamford, Conn.

[21] Appl. No.: 107,124

[22] Filed: Oct. 9, 1987

[51] Int. Cl.[4] ..... G03G 15/00

[52] U.S. Cl. ..... 355/14 SH; 355/3 SH; 271/8.1

[58] Field of Search ..... 355/14 SH, 3 SH, 14 R, 355/3 R, 14 C; 271/3.1, 8 R, 182

[56] References Cited

U.S. PATENT DOCUMENTS

| | | | |
|---|---|---|---|
| 4,392,740 | 7/1983 | Ito et al. | 355/14 SH |
| 4,472,049 | 9/1984 | Honma et al. | 355/14 SH |
| 4,549,805 | 10/1985 | Iimori | 355/3 SH |
| 4,589,765 | 5/1986 | Perun et al. | 355/3 SH |
| 4,627,711 | 12/1986 | Schron | 355/14 SH |
| 4,719,489 | 1/1988 | Ohkubo et al. | 355/14 SH X |
| 4,733,281 | 3/1988 | Yoshinaga et al. | 355/14 SH X |

OTHER PUBLICATIONS

Xerox Disclosure Journal, vol. 9, No. 6, Nov./Dec. 1984, "Title of Disclosure:" Adaptive Algorithm for RDH's (ABC Equation), Author: Michael S. Doery.

*Primary Examiner*—A. C. Prescott

*Attorney, Agent, or Firm*—Ronald F. Chapuran

[57] ABSTRACT

A technique for expanding the control windows or time periods between sensors in a real time machine for diagnostics. In particular, upon indication of a malfunction of the travel of a sheet between sensors, a Service Representative is able to place the machine in a diagnostic mode and expand the time period or window for determining more precisely the degree of deviation of the errant time period from the standard range.

5 Claims, 5 Drawing Sheets

MONITORING WINDOW EXPANSION FOR DIAGNOSTICS

BACKGROUND OF THE DISCLOSURE

The invention relates to image marking machines and more particularly to the use of paper travel diagnostics in image marking machines.

It is important to the maintenance of complex electronic equipment such as reproduction machines to reduce the service calls and time spent in monitoring and maintaining the machine operation, in particular reducing the cost of maintenance and service.

Diagnostic procedures related to sheet travel are already well known. For example, it is known to use sensors to detect the presence of paper sheets traveling along the paper path, a memory for storing electrical representations of time for the sheet to travel between the sensors, and a display for indicating the sheet travel time.

It is also known that time periods of paper path travel between various sensors can be displayed for a previous copy run. U.S. Pat. No. 4,335,949 discloses a reproduction machine having a recirculating document handler, a display, and the means to enter a diagnostic mode for immediate access to time periods between sensors detecting document travel in the document handler. Upon entering the diagnostic mode, the first requested event of six events or time periods is displayed, the display providing the number of the event and the time period in milliseconds.

In addition, U.S. Pat. No. 4,589,705 discloses a method for adjusting the operational timing of the copy sheet feeder in a reproduction machine by determining the current copy sheet feeding time interval required for the copy sheet feeder to advance a copy sheet to a predetermined point in the copy processing path following actuation thereof by the machine control system. The control then compares the current copy sheet feeding time interval with an optimum copy sheet feeding time interval stored in the machine memory, and adjusts the sheet feeder timing so that the sheet feeding time interval of the sheet feeder substantially equals the optimum copy sheet feeding time interval stored in the machine memory.

U.S. Pat. No. 4,627,711 discloses a control data base including a packet phase describing the origin and destination and all specific details of how each individual copy sheet is to move through the system, a tracker phase showing the current physical location of the sheet in the system, wherein both the lead edge and the trail edge of each sheet is tracked and dynamically updated at each control point, and a fault phase showing that a fault has been responded to by the system.

Xerox Disclosure Journal, Vol. 9, No. 6 Nov/Dec 1984 discloses that the actual transport time (between sensors) from the initial acquisition of a document to its positioning on the platen can be measured for a recirculating document handler. This information is then used to provide a specific maximum or total time to be allowed by the control system of that copier for each document exchange (called the feed-to-flash time). This was in lieu of the standard practice of presetting a much longer fixed allowed time for all document exchanges, which fixed time was calculated for the worst conditions.

A difficulty with the prior art systems is that once a control time period or window is set, for example, between sensors in a specific machine, this time period or window cannot be varied in that particular machine. For diagnostic purposes, however, it would often be desirable to be able to expand a control time period or window. Often time, a fixed control window for viewing the time period between sensors does not provide enough flexibility for a service representative to diagnose a situation. For example, if the time elapsed for a document or copy sheet to traverse between a pair of sensors exceeds the normal or accepted control window, an error signal will be generated and stored in memory for later display to the Service Representative. However, it is often important for the Service Representative to be able to diagnose the degree of deviation from the normal, to know if the elapsed time was substantially greater or only slightly greater than the normal window. This could often indicate to the Service Representative the source of the malfunction, such as an electrical or mechanical source. In prior art control systems, the Service Representative is not able to determine the degree of deviation and better able to pinpoint the source of malfunction.

It is an object of the present invention, therefore, to provide a new and improved control and diagnostic method that expands the normal fixed windows or time periods in the operation of a machine when the machine is in a diagnostic mode.

Further advantages of the present invention will become apparent as the following description proceeds, and the features characterizing the invention will be pointed out with particularity in the claims annexed to and forming a part of this specification.

Briefly, the present invention is a technique for expanding the control windows or time periods between sensors in a real time machine for diagnostics. In particular, upon indication of a malfunction of the travel of a sheet between sensors, a Service Representative is able to place the machine in a diagnostic mode and expand the time period or window for determining more precisely the degree of deviation of the errant time period from the standard range.

For a better understanding of the present invention reference may be had to the accompanying drawings wherein the same reference numerals have been applied to like parts and wherein.

Figure 1:
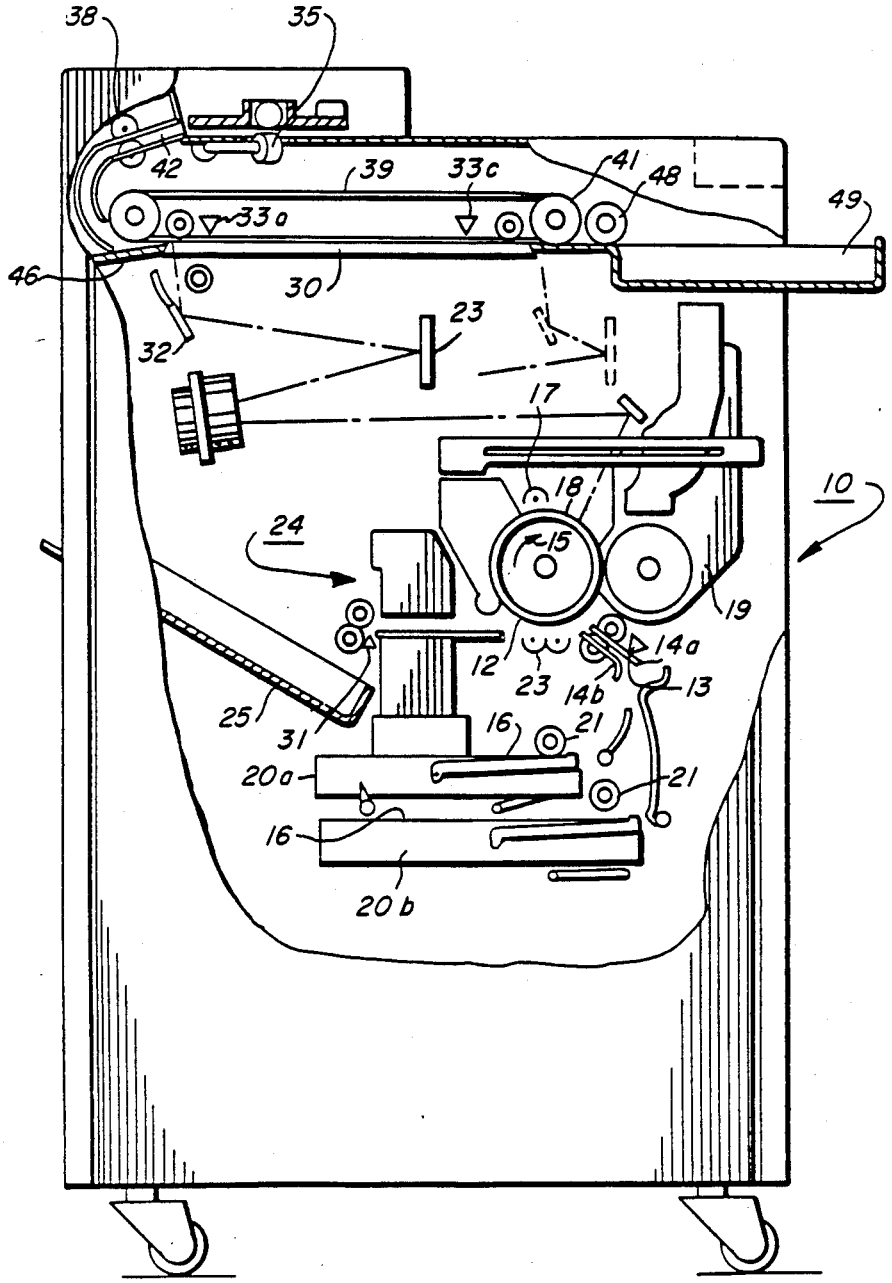
FIG. 1 is an elevational view of a reproduction machine incorporating the present invention.

Referring now to FIG. 1, there is shown by way of example a reproduction machine 10 including an image recording drum-like member 12, its outer periphery coated with a suitable photoconductive surface. The drum 12 moves the photoconductive surface in the direction of arrow 15 through a charging station 17 providing an electrostatic charge uniformly over the photoconductive surface.

Thereafter, the drum 12 is rotated to exposure station 18 and the charged photoconductive surface is exposed to a light image of the original document to be reproduced. The charge is selectively dissipated in the light exposed regions to record the original document in the form of an electrostatic latent image. After exposure, drum 12 rotates the electrostatic latent image recorded on the photoconductive surface to development station 19 wherein a conventional developer mix is applied to the photoconductive surface of the drum 12 rendering the latent image visible.

Copy sheets 16 of the final support material are supported in a stack arrangement on either elevating stack main tray 20*a* or auxiliary tray 20*b*. With the stack at its elevated position, a sheet separator 21 feeds individual sheets therefrom to a registration system. The registration system includes registration switch 13 and registration rolls 14*a* and 14*b* before transfer.

The sheet is then forwarded to the transfer station in proper registration with the image on the drum 12. The developed image on the photoconductive surface is brought into contact with a copy sheet 16 and the toner image is transferred from the photoconductive surface to the contacting side of the copy sheet 16. Following transfer of the image the final support material is transported through a detack station where detack corotron 23 uniformly charges the support material to separate it from the drum 12.

The copy sheet 16 is then advanced to a suitable fusing station 24 for coalescing the transferred powder image to the support material. After the fusing process, the copy sheet 16 is advanced to a suitable output device such as tray 25.

The original document to be reproduced is placed image side down upon a horizontal transparent plate 30 and scanned by means of a moving optical system. The scanning system includes a stationary lens and a pair of cooperating movable scanning mirrors. The scanning mirrors include a half rate mirror 31 and full rate mirror 32 supported upon carriages (not illustrated). Disposed along the platen 30 are a scan switch 33*a* and an end of scan switch 33*c*.

A document handler is also provided including a registration assist roll 35 activated when a document is inserted. Pinch rolls 38 are activated to feed the document around 180 degree curved guides 42. The document is driven onto the platen 30 by a platen belt transport 39. After copying, the platen transport 39 is activated and the ;document is driven off the platen by the output pinch roll 48 into the document catch tray 49.

Figure 2:
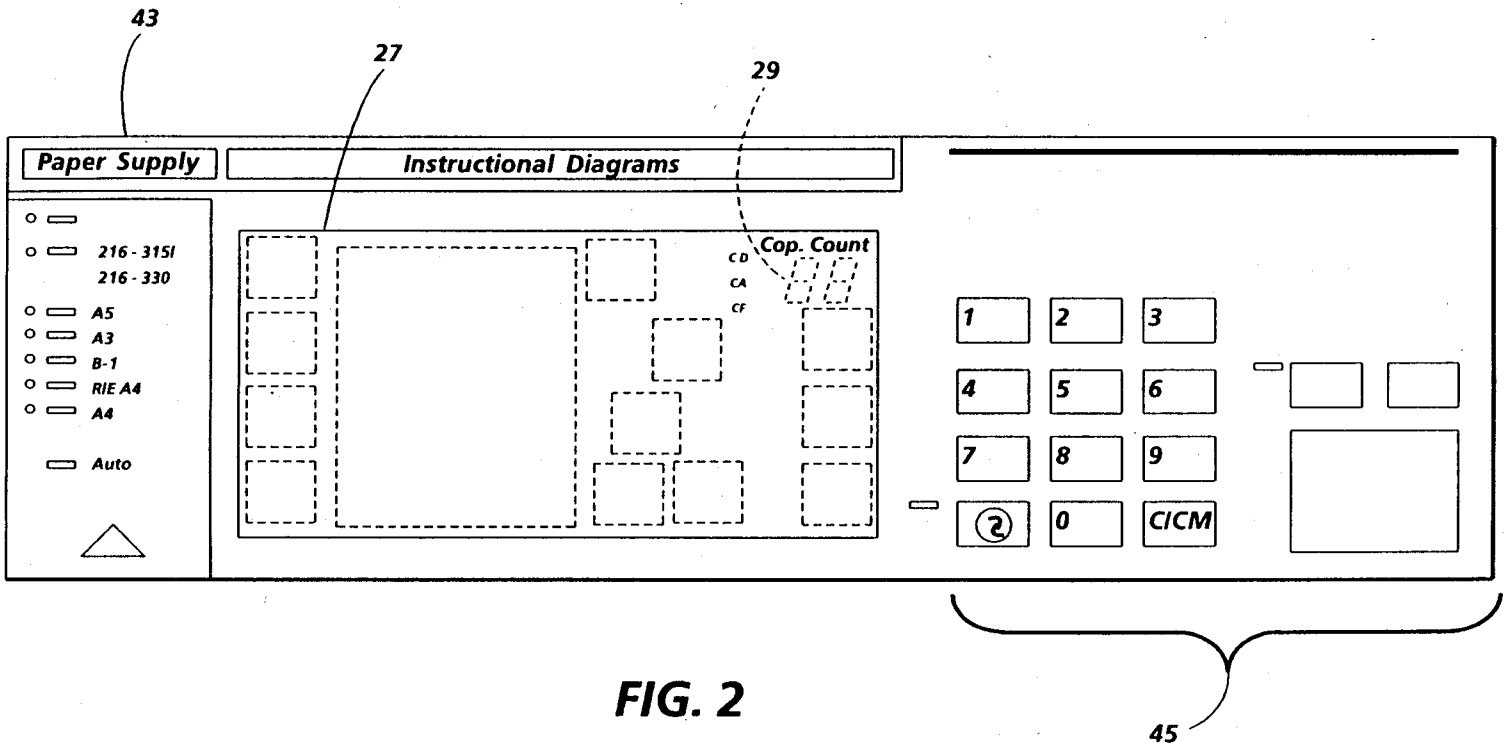
FIG. 2 illustrates the control panel of the machine of FIG. 1.

With reference to FIG. 2, by way of example, there is shown the machine control panel 43 including a keyboard 45 suitable function buttons and a display 27 including copy count indicator 29. Typically, the control panel switches and indicators are connected to the machine control as shown in FIG. 3.

Figure 3:
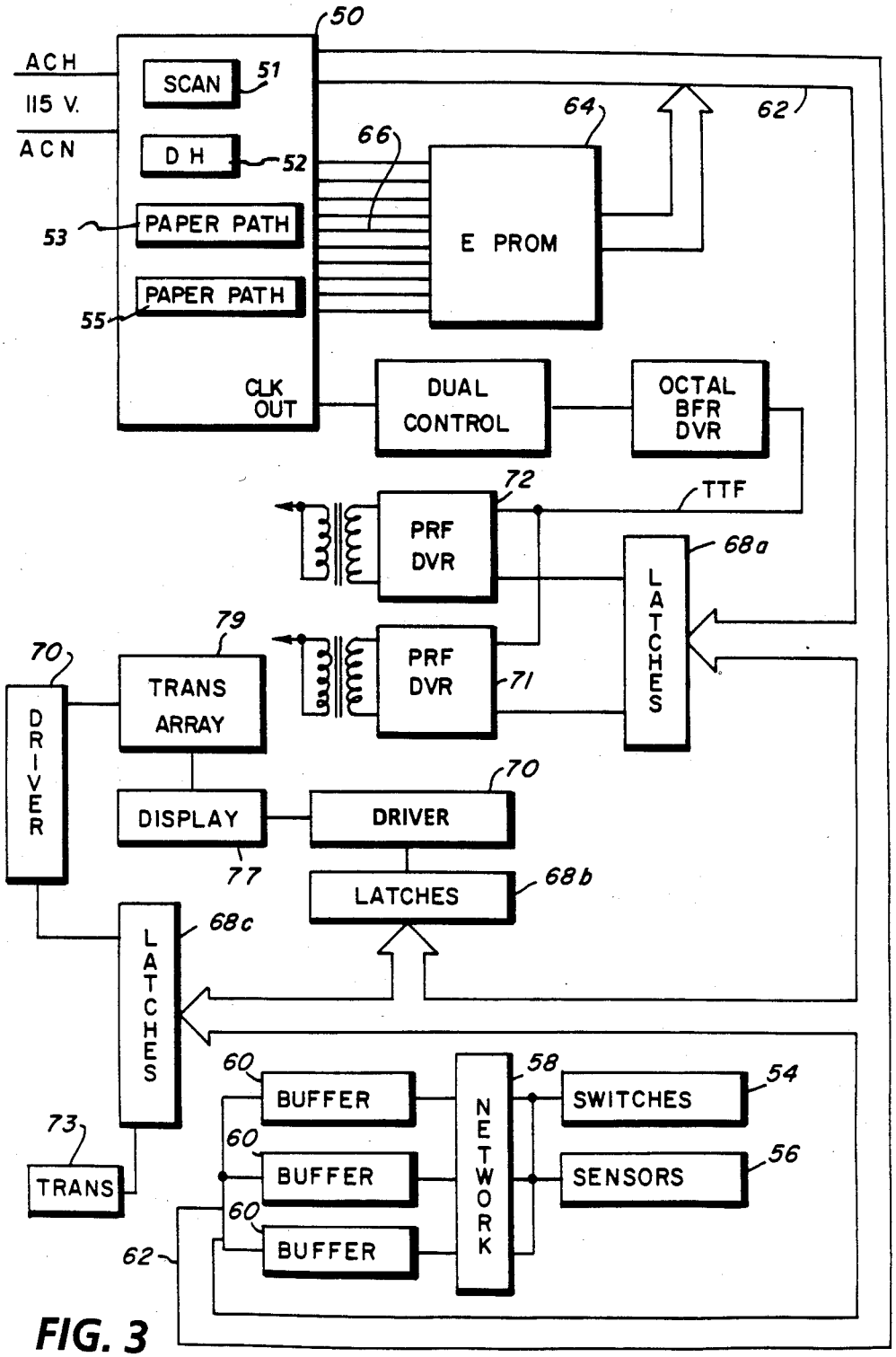
FIG. 3 is a block diagram of a representative controller of the machine of FIG. 1.

With reference to FIG. 3, there is shown a typical controller including microprocessor 50 with four dedicated registers, a scan register 51, a document handler register 52, and a pair of paper path registers 53 and 55. The reproduction machine also includes other, not shown, power supplies and distribution circuitry. A bidirectional bus 62 interconnects the microprocessor 50 and the reproduction machine and generally conveys signals from sensors 56 and switches 54 of the reproduction machine to microprocessor 50 and conveys control signals from microprocessor 50 to the reproduction machine.

The signals of various reproduction machine switches 54 and sensors 56 are conveyed through a resistance network 58 and suitable buffers 60 to the 8 bit external data bus 62 connected to microprocessor 50. The 8 bit data bus is also connected to a suitable memory device such as EPROM 64 interconnected to microprocessor 50 through suitable address lines 66. It should be noted that the EPROM device 64 can be replaced by a suitable read only memory ROM internal to the microprocessor 50.

Outputs to the reproduction machine controlled elements are conveyed fro the microprocessor 50 along the external data bus 62 to various latches 68*a*, 68*b* and 68*c*. The latches are interconnected to various drivers 70, 71 and 72, or transistors 73 to activate various clutches, solenoids, motor drives, triacs and power supplies in the reproduction machine. For a more detailed description reference is made to U.S. Pat. No. 4,477,901 incorporated herein.

Typically, in the prior art, in monitoring the the feed of copy sheets, error signals are generated and either displayed and or stored in memory if the copy sheet does not pass between sensors or reach a specific sheet sensor within a given period of time. For example, when a feeder clutch is turned on to feed a copy sheet from one of the copy sheet feed trays 20*a*, 20*b*, the time period from the turn on of the feeder clutch until the lead edge of the copy sheet reaches the registration switch 13 is monitored. If the copy sheet does not reach the registration swtich within that time period, for example, 800 milliseconds, an error signal is generated.

A quantity select indicator 29 on the control panel 43 an be used by the Service Representative to read the time elapsed, for example, 780 milliseconds, if the copy sheet feed reaches the registration swtich within the 800 millisecond time period or window. A problem exists however if the delay is greater than the 800 millisecond window. If the time period for the copy sheet to reach the registration switch is greater than 800 milliseconds, the only indication to the Service Representative will be the generation of an error signal for example a C-1 indication on the display The time period can be 820 milliseconds, very close to the accepted time frame indicating minor slippage or the time period can be much larger more likely indicating an electrical malfunction rather than a mechanical malfunction in the control. For example, in cases where the Service Representative is able to view the paper traveling to or under a sensor, and the paper movement appears to be normal; an extremely high on maximum reading (2×the jam window) would almost point to an electrical problem.

In accordance with the present invention, in a diagnostic mode, the Service Representative can expand the window or time frame for determining more precisely the time period for the copy sheet to reach the sensor. Thus the Service Representative can more precisely pin point the cause of the delay and source of the malfunction. It should be noted that the window can be expanded in the Service Representative mode for any desired measurements such as the time period for the trail edge of a copy sheet to clear the registration switch in addition to the lead edge of the copy sheet to reach the registration switch or such time periods as the lead edge of the copy sheet to reach the exit sensor or the trail edge of the copy sheet to clear the exit sensor 31.

Figure 4:
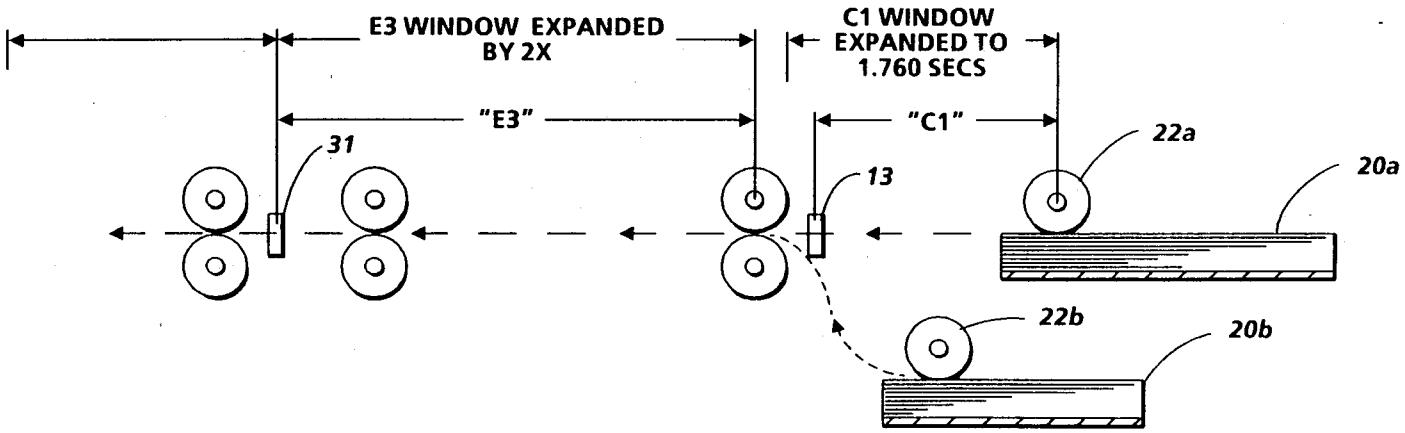
FIGS. 4 and 5 are illustrative examples of the window expanding technique in accordance with the present invention.
Figure 5:
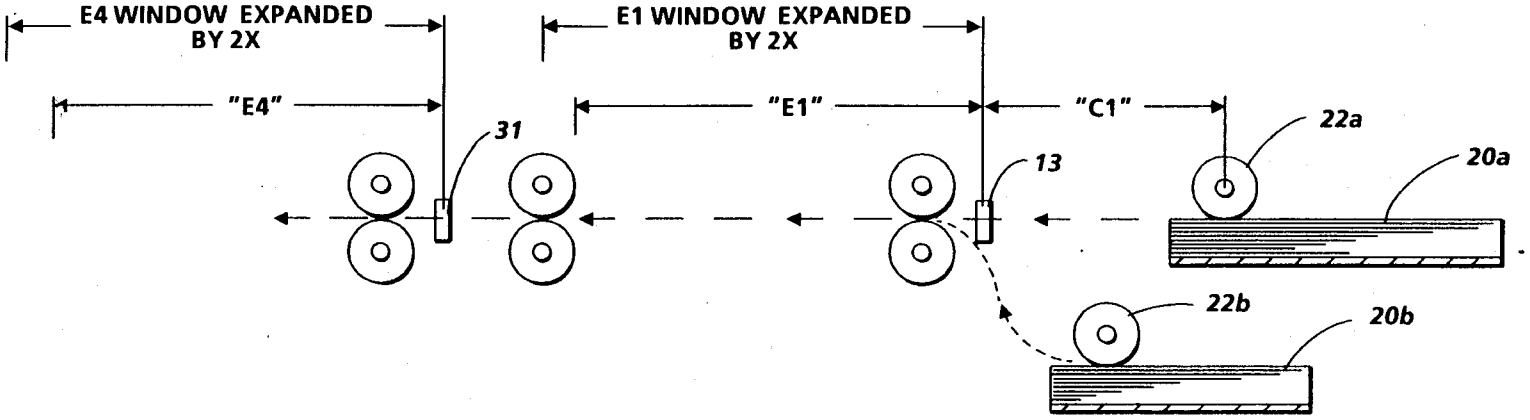

FIGS. 4 and 5 are examples illustrating the present invention and the adaptability of the machine to accommodate expanded windows or time periods to diagnose machine operation. FIG. 4 illustrates a timing and a diagnostic routine to measure the time period from the turnon of a feed clutch to move a copy sheet to the registration switch 13. Typically, as is well known, a numbered code is entered at the keyboard to place the machine in the diagnostic mode and to identify the type of diagnostic procedure to measure the time period to the registration switch. Upon the activation of a start switch, only the necessary subsystem drives will be turned on, and in this particular case, a paper path drive motor turns on, a feed clutch turns on, a registration switch actuates, the system pauses 20 milliseconds and a registration clutch turns on the registration rolls. After the paper passes the registration area, in this test, it will be transported to the exit rolls and to the output tray.

During the monitoring process, a message "please wait" will be displayed to identify the start of the process and change to "ready" when the sensor senses the paper lead edge. This links the microprocessor response to the timing check and will allow also a visual comparison between paper observed and the electronic system's response. When the panel message changes to "ready to copy", the quantity select indicator will display the seconds, for example, 01, 03, etc., then flash the millisecond 10, 20, 30, etc. to reflect within tenths of a millisecond the "real time to sensor".

As depicted in FIG. 4, paper is fed from one of the paper trays 20*a* or 20*b* by feed clutches 22*a* and 22*b* to the registration sensor 13. In a specific embodiment, the standard or expected time for the copy sheet from the time of activation of feed clutch 22*a* or 20*b* until the leading edge of the copy sheet reaches the registration sensor 13 is no greater than 880 milliseconds illustrated by "C1". If the time period exceeds 880 milliseconds, an error code will be generated. The standard or expected time for the copy sheet to go from the registration rolls to activation of the exit sensor 31 is 2.5 seconds illustrated by "E3". In accordance with the present invention, when the machine is put i the diagnostic mode, the window or the time of measuring the travel of the copy sheet from the time of the activation of the feed clutch to activation of the sensor 13 is expanded, in a preferred embodiment to twice the initial window or 1.760 seconds. Similarly, the window for diagnosing the travel of the copy sheet from the registration rolls to the exit sensor 31 is expanded, preferably, by twice the window or normal machine operation or to 5.0 seconds. Thus, if the time period exceeds the 880 milliseconds to reach the registration sensor 13, the Service Representative will have an additional 880 milliseconds to determine the exact time of error, for example, 900 milliseconds or 1.5 seconds, rather than just receiving an error code signal. In this manner, the Service Representative can more precisely pinpoint the source of the malfunction.

Similarly, with respect to FIG. 5, there is illustrated the system for measuring and diagnosing the time that a copy sheet travels underneath either sensor 13 or sensor 31. Once the system is put in the diagnostic mode, a message "please wait" will identify the start of the process. This indication will remain on during the time the sensor senses paper traveling underneath the sensor. The please wait message will go off when the trail edge of the copy sheet has been sensed. As before, this will link the microprocessor response to the timing check and allow a visual comparison between the paper observed under the sensor and the electronic timing system response. When the panel message changes from please wait to "off", the quantity select indicator will display seconds, for example, 01, 02, 03, then flash milliseconds 10, 20, 30, etc to reflect within tenths of a millisecond the "real time under sensor". With respect to FIG. 5, the time period from the registration clutch on to the sensor 13 de-actuated is 1.870 seconds assuming an $8\frac{1}{2}\times 11$ sheet. This is illustrated by "E1" in the diagram. According to the present invention, in the diagnostic mode, this time period is expanded by 2 in a preferred embodiment, as illustrated. Similarly, the time period from the sensor 31 activation to the sensor 31 deactivation is 1.90 seconds illustrated by E4. However, in the diagnostic mode, this window is expanded by 2 to 3.8 seconds.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

I claim:

1. A method of sheet feeder diagnostics in a reproduction machine having a control means and a sheet feeder for advancing sheets in seriatim along a sheet path, said sheet path having a sensor for sensing movement of the sheets in said path, said control means including a memory and display for manifesting machine faults and having a logic means providing a first control window time frame for monitoring the movement of the sheets along the sheet path comprising the steps of:

manifesting a plurality of machine faults in said reproduction machine relating to the movement of the sheets along the sheet path, putting the machine in a diagnostics mode in response to the manifestation of the plurality of machine faults, providing a second control window time frame for diagnosing the movement of the sheets along the sheet path, the length of time of the second window being greater than the length of time of the first window, exercising the machine components related to the movement of the sheets along the sheet path, and determining the cause of the faults in the machine based upon the monitoring of the sheets during the second window time frame.

2. The method of claim 1 wherein the second window time period is twice the first window time period.

3. The method of claim 1 wherein the sensor monitors sheet lead edge and sheet rail edge along the sheet path.

4. The method of claim 1 wherein the step of determining the cause of the faults includes the step of isolating the faults to either a mechanical or an electrical malfunction.

5. A method of diagnostics in a reproduction machine having a control means and a sensor for sensing machine operation, said control means including a memory and display for manifesting machine faults and having a logic means providing a first control window time frame for monitoring said machine operation comprising the steps of:

manifesting a plurality of machine faults in said reproduction machine relating to said machine operation, putting the machine in a diagnostics mode in response to the manifestation of the plurality of machine faults.

providing a second control window time frame for diagnosing said machine operation, the length of time of the second window being greater than the length of time of the first window, and determining the cause of the faults in the machine based upon the monitoring of said machine operation during the second window time frame.

* * * * *